US005893290A

United States Patent [19]

Chang

[11] Patent Number: 5,893,290

[45] Date of Patent: Apr. 13, 1999

[54] SCREWHEAD FORMING APPARATUS

[75] Inventor: Yun-Te Chang, Tainan, Taiwan

[73] Assignee: FWU Kuang Enterprises Co., Ltd., Tainan Hsien, Taiwan

[21] Appl. No.: 08/904,915

[22] Filed: Aug. 1, 1997

[51] Int. Cl.[6] ..... B21J 7/12

[52] U.S. Cl. ..... 72/434; 72/466.9; 470/139; 470/143

[58] Field of Search ..... 72/433, 434, 352, 72/354.8, 355.2, 465.1, 466.9, 358, 359; 470/57, 137–139, 141, 143, 145

[56] References Cited

U.S. PATENT DOCUMENTS

| | | | |
|---|---|---|---|
| 1,642,736 | 9/1927 | Lyman | 72/355.2 |
| 2,815,200 | 12/1957 | Gerhart et al. | 72/434 |
| 3,359,580 | 12/1967 | Osman et al. | 470/143 |
| 4,073,178 | 2/1978 | Dutarte et al. | 72/352 |
| 4,693,109 | 9/1987 | Conner et al. | 72/359 |
| 5,600,992 | 2/1997 | Kanazawa et al. | 72/352 |

*Primary Examiner*—Joseph J. Hail, III
*Assistant Examiner*—Ed Tolan
*Attorney, Agent, or Firm*—Skjerven, Morrill, MacPherson, Franklin & Friel LLP; Alan H. MacPherson

[57] ABSTRACT

A screwhead forming apparatus includes an operating mechanism driven to reciprocate, a male die driven by the operating mechanism to reciprocate and having a die cavity of a predetermined shape, a stationary female die, and a punch rod driven by the operating mechanism to impel the blank into the die cavity of the male die so as to forge an elongated blank. A compression spring assembly consists of a plurality of spring units which are disposed between the operating mechanism and the male die and which have different spring forces so that the spring assembly creates a successively increasing spring force to bias the male die to press against the female die after the male die is brought to contact the female die by the operating mechanism during movement of the punch rod relative to the female die. The spring units are compressed completely just before the blank is moved entirely into the die cavity of the male die so as to prevent removal of the male die from the female die.

3 Claims, 12 Drawing Sheets

SCREWHEAD FORMING APPARATUS

BACKGROUND OF THE INVENTION

1. Field of the Invention

This invention relates to a screwhead forming apparatus, more particularly to a screwhead forming apparatus in which an elongated blank is forged directly to form a screwhead according to the shape of the die cavity of a forging die set in such a manner that no waste is created.

2. Description of the Related Art

Referring to FIG. 1, a conventional screwhead forming apparatus 1 is shown to include a feeding mechanism 11 disposed on a machine bed 10, a blocking mechanism 12, and a cutting mechanism 13. When an elongated blank 2 is held on a chuck 130 and engages the blocking mechanism 12, a cutting member 131 cuts the blank 2 to form a blank section 20 of a predetermined length which is moved by a push pin 14 away from the cutting member 13. Then, the blank section 20 is sent to a forging die mechanism 15 which includes fixed tubular die members 150, 151, 152 and punch-moved die members 153, 154, 155. The die members 153, 154, 155 are driven by a flywheel (not shown) and a crank (not shown) to reciprocate relative to the die members 150, 151, 152. In the die mechanism 15, the blank section 20 (see FIG. 2A) projects from the tubular die member 150 and is forged by means of the punch-moved die member 153 to form a first semi-finished product 21 (see FIG. 2B) which is further forged by means of the die members 151, 154 to form a second semi-finished product 22 (see FIG. 2C) that is further dealt with by means of the die members 152, 155 to form a final product 23 (see FIG. 2D) with a screwhead 24 (see FIG. 2E). The final product 23 is then pushed out of the die member 152 by means of a pushing rod 156. It is understood that a large amount of waste, which is about 6 to 30% according to the size of the final product 23, is created in the process of forming the hexagonal head of the final product 23 (see FIG. 2D) from the second semi-finished product 22.

To save the material, it is intended that a screwhead can be formed directly by a die forging process whereby no material is cut off. In such a process, a spring is needed to press a movable die, which is carried on a punch rod, against a stationary die. In a case where the spring has a sufficient spring force to press firmly the movable die against the stationary die, the compressible length of the spring is too small to conform with the one-stroke travel of the punch rod during the die forging process. Conversely, in a case where the spring has a sufficient compressible length, the spring force of the spring is too small to press firmly the movable die against the stationary die. As a result, a single spring cannot be useful for forming a screwhead in a forging die set during one stroke of the punch rod.

SUMMARY OF THE INVENTION

An object of this invention is to provide a screwhead forming apparatus with a compression spring assembly which has a sufficient spring force to press firmly a movable die against a stationary die, and a sufficient compressible length to conform with the one-stroke travel of a reciprocal punch rod so that a screwhead can be formed directly in a forging die set during one stroke of the punch rod, thereby eliminating the creation of waste.

According to this invention, a screwhead forming apparatus includes a female die, an operating mechanism drivable to reciprocate relative to the female die, a male die driven by the operating mechanism to reciprocate relative to the female die and having a die cavity of a predetermined shape, and a punch rod driven by the operating mechanism to impel an elongated blank into the die cavity of the male die so as to forge the blank. A compression spring assembly consists of a plurality of spring units which are disposed between the operating mechanism and the male die and which have different spring forces so that the spring assembly creates a successively increasing spring force to bias the male die to press against the female die after the male die is brought to contact the female die by the operating mechanism during movement of the punch rod relative to the female die, so that the spring units are compressed completely just before the blank is moved entirely into the die cavity of the male die so as to prevent removal of the male die from the female die.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
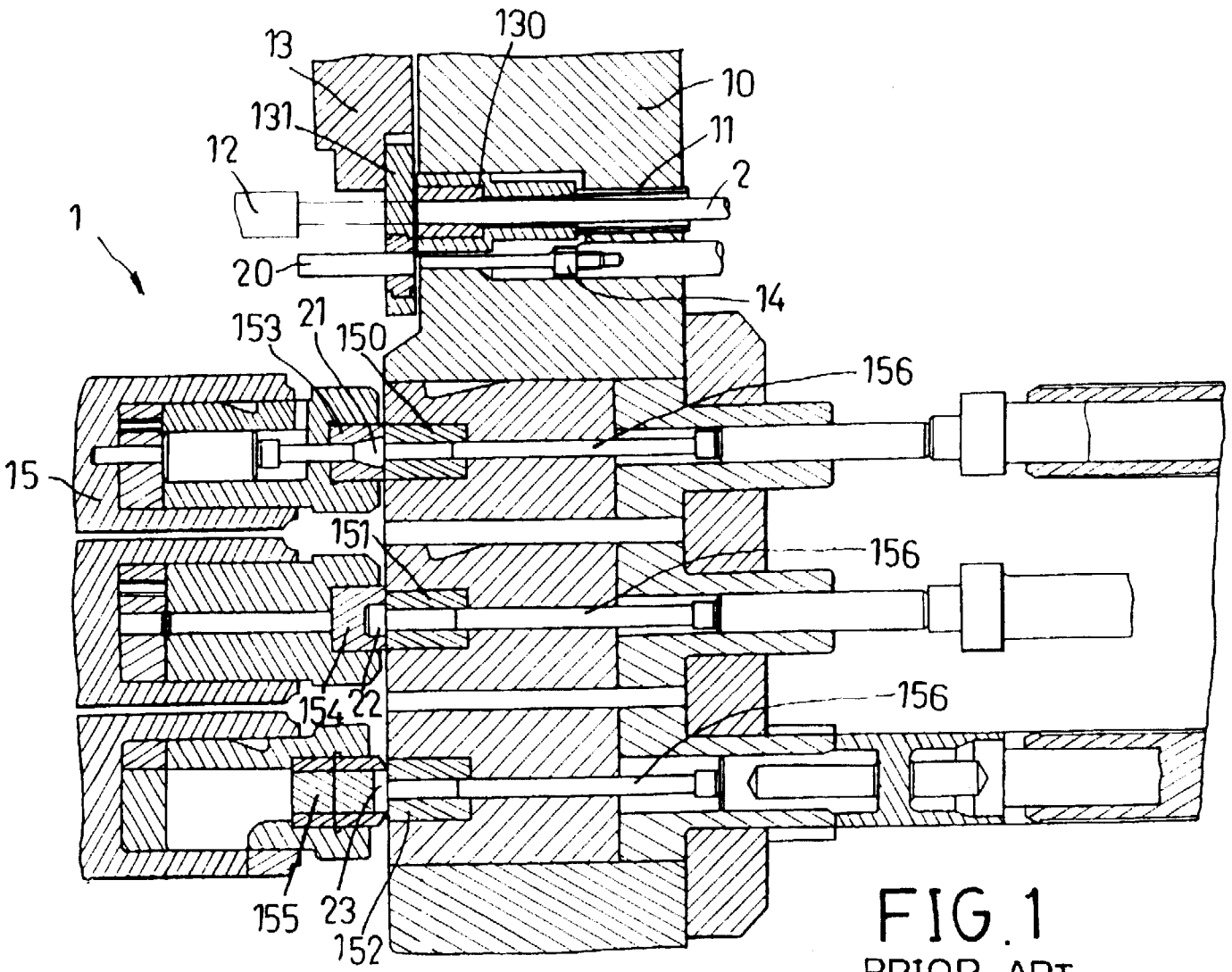
FIG. 1 PRIOR ART
FIG. 1 illustrates a conventional screwhead forming apparatus.
Figure 2A:
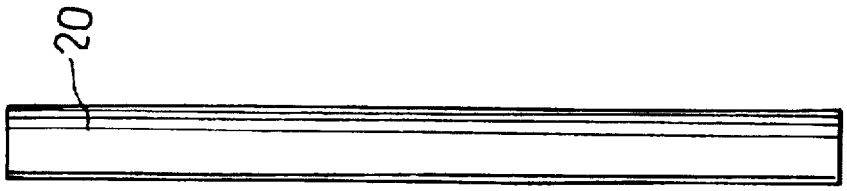
FIG. 2A PRIOR ART
FIGS. 2A, 2B, 2C and 2D illustrate how a screwhead is formed in the conventional screwhead forming apparatus.
Figure 2B:
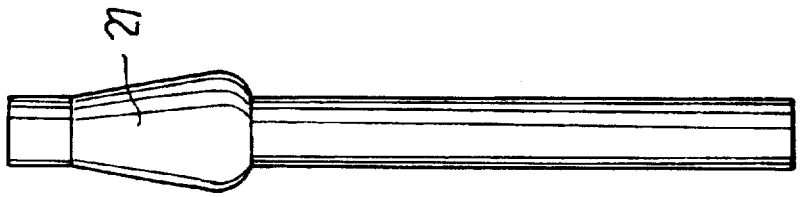
FIG. 2B PRIOR ART
Figure 2C:
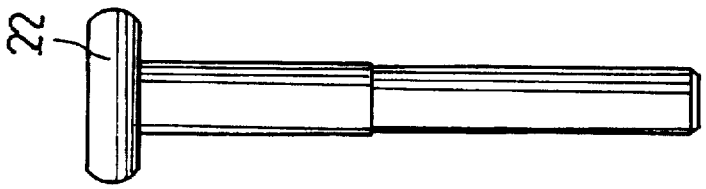
FIG. 2C PRIOR ART
Figure 2D:
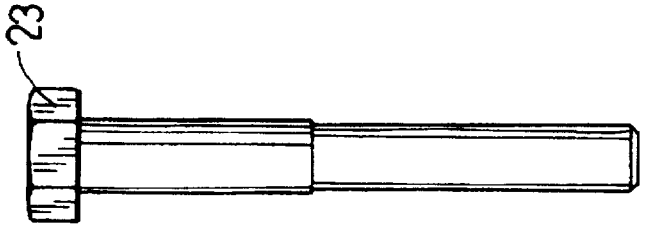
FIG. 2D PRIOR ART
Figure 2E:
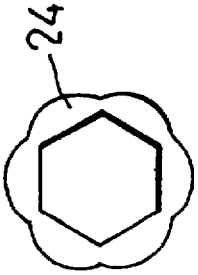
FIG. 2E is a top view of a bolt shown in FIG. 2D.
Figure 3:
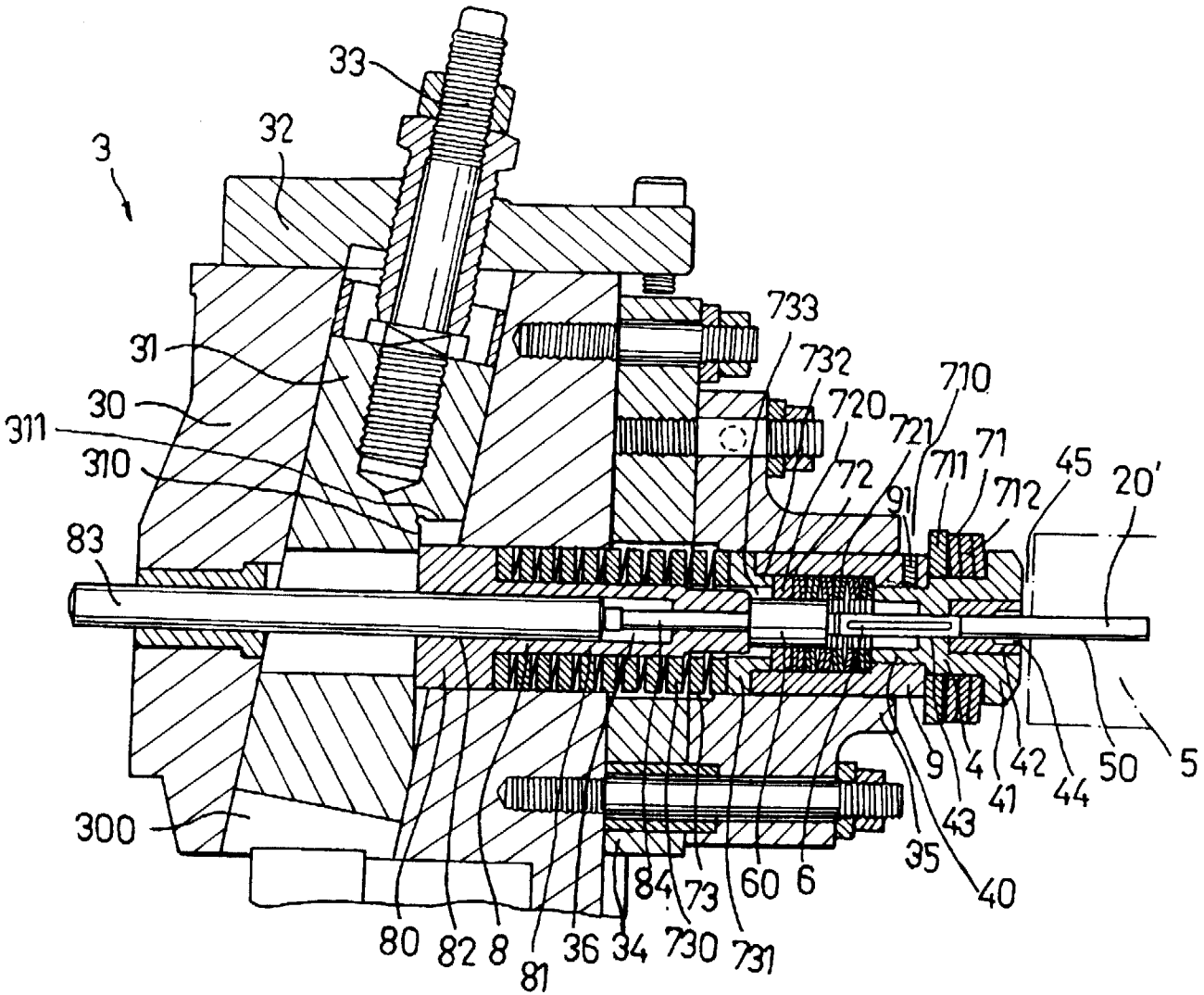
FIG. 3 is a sectional view of a first embodiment of a screwhead forming apparatus according to this invention.

Referring to FIG. 3, a first embodiment of a screwhead forming apparatus of this invention is shown to include an operating mechanism 3, a male die 4, a female die 5, a punch rod 6, a first spring unit 71, a second spring unit 72, a third spring unit 73, a tubular first pusher 8 and a retainer 9. The dies 4, 5 constitute a first die set. The spring units 71, 72, 73 constitute a compression spring assembly. The spring force of the second spring unit 72 is smaller than that of the first spring unit 71 and is larger than that of the third spring unit 73. The maximum compressible length of the second spring unit 72 is larger than that of the first spring unit 71 and is smaller than that of the third spring unit 73.

The operating mechanism 3 can be driven by a flywheel (not shown) and a crank (not shown) to reciprocate and includes a main sliding plate 30 formed with an inclined slot 300 in which an adjustment block 31 is received slidably. As illustrated, the right side of the block 31 has a corner notch which is defined by a vertical pushing surface 310 and a horizontal surface 311. An internally threaded plate 32 is fixed on the top end of the main sliding plate 30 so that an adjustment bolt 33 extends threadedly through the plate 32 to couple with the block 31. Rotation of the bolt 33 relative to the plate 32 slides the block 31 within the slot 300, thereby moving horizontally the vertical pushing surface 310 of the block 31 in the main sliding plate 30. A vertical plate 34 mounts a die seat 35 on the main sliding plate 30. An axial hole 36 is formed through the operating mechanism 3. Because the structure and operation of the operating mechanism 3 are known in the art, further description thereof will be omitted herein.

In the axial hole 36 of the operating mechanism 3, there are provided a tubular first pusher 8, a second pusher 60, the punch rod 6, the third spring unit 73, the second spring unit 72 and an internally threaded retainer 9. The first spring unit 71 is sleeved on the male die 4 and is located near the die seat 35. As illustrated, the male die 4 has an enlarged end section 41 and a narrowed end section 40 which extends into the axial hole 36 and which is externally threaded so as to engage threadably the internally threaded retainer 9, thereby retaining the first spring unit 71 between the enlarged end section 41 of the male die 4 and the retainer 9. As illustrated, the retainer 9 is locked on the male die 4 by means of a lock bolt 91.

The tubular first pusher 8 has a large-outer-diameter left portion 80 abutting against the pushing surface 310 of the block 31, a small-outer-diameter right portion 81 on which the third spring unit 73 is sleeved, and a central bore 82 in which a die-lifting main rod 83 and a die-lifting auxiliary rod 84 are provided slidably. The third spring unit 73 consists of a compression spring 730 and is provided with a positioning ring 731 so as to confine the third spring 730 between the large-outer-diameter left portion 80 of the first pusher 8 and the positioning ring 731.

As illustrated, the second pusher 60 has a left end engaging the right end of the first pusher 8, and a right end engaging the left end of the punch rod 6 so as to move the punch rod 6 synchronously with the operating mechanism 3.

The second spring unit 72 consists of a disk spring set 721 and is provided with a washer 720 which is located between the positioning ring 731 and the disk spring set 721 in such a manner that a space 733 is left between the first pusher 8 and the washer 720. The disk spring set 721 is sleeved on the second pusher 60 and the punch rod 6 and is located within the retainer 9.

The first spring unit 71 consists of a disk spring set 712 and a washer 711 which is biased by the disk spring set 712 to press against the retainer 9. Because the right end portion of the retainer 9 extends from the axial hole 36 of the operating mechanism 3, a space 710 is left between the die seat 35 and the washer 711.

The male die 4 has a die core 42 made of tungsten carbide, and a hole 43 which is formed in the outer surface of the male die 4 and which is communicated with a die cavity 44 that is formed in the die core 42 and that has a circular cross-section. When the operating mechanism 3 is activated by a crank (not shown), the pushing surface 310 of the block 31 pushes the first and second pushers 8, 60 to the right so as to move the punch rod 6 within the hole 43 to impel an elongated blank 20' into the die cavity 44. A space 45 is left between the dies 4 and 5. The female die 5 has a cylindrical die cavity 50 which receives the portion of the blank 20' to be formed as the threaded section of a bolt.

FIGS. 4 to 7 illustrate one stroke of the punch rod on the blank within a very short time, which takes place during a half revolution of the crank (not shown) that activates the operating mechanism 3.

Figure 4:
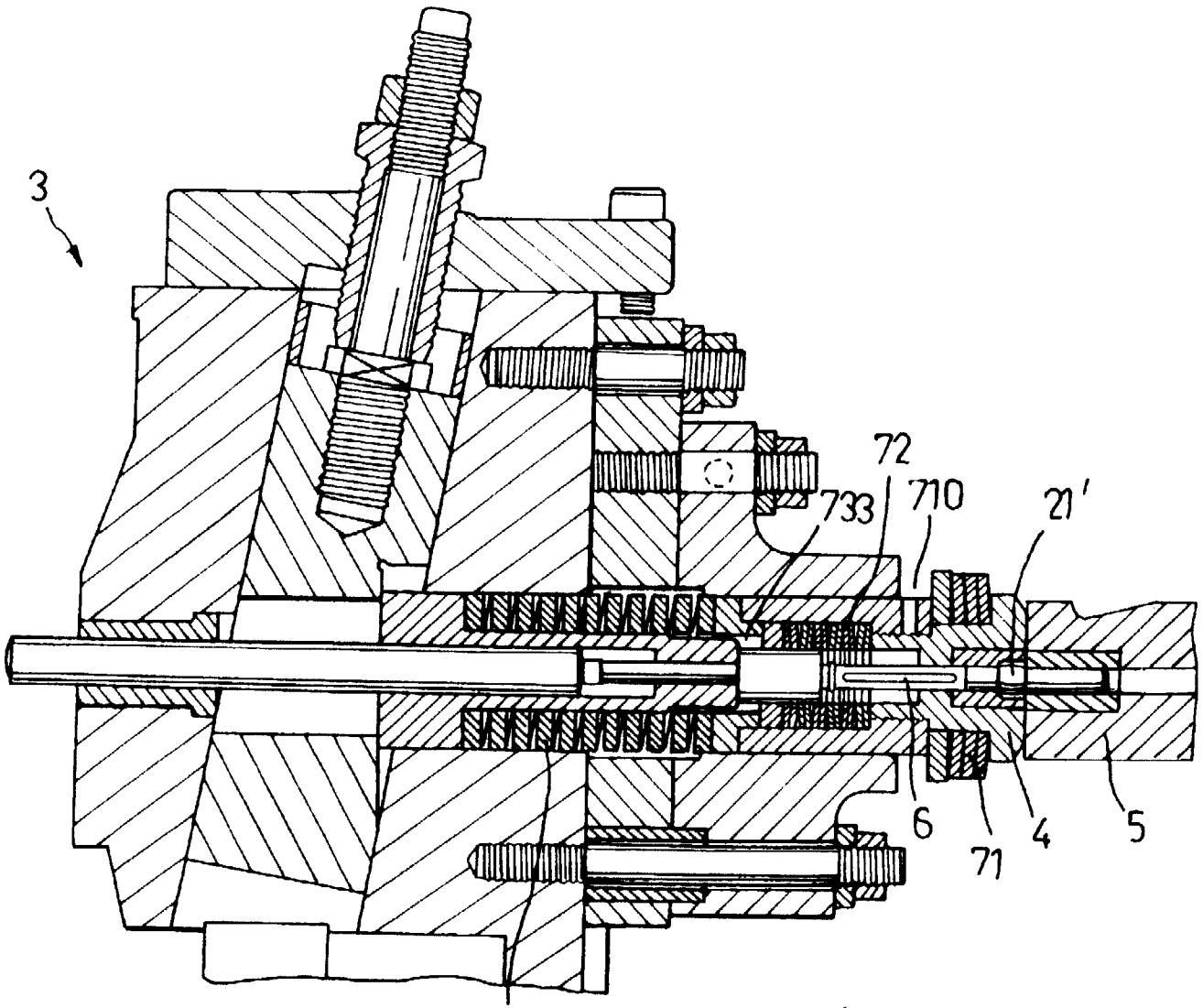
FIGS. 4 to 7 illustrate how a screwhead is formed in a first die set of the first embodiment.

Referring to FIG. 4, when the operating mechanism 3 and the punch rod 6 are moved to a position in which the male die 4 contacts the female die 5, the blank is further pressed into the male die 4 and is forged to form a first semi-finished product 21' which is formed with an enlarged section within the male die 4. Because the male die 4 contacts and cannot move relative to the female die 5, subsequent movement of the punch rod 6 in the male die 4 compresses the spring assembly which consists of the spring units 71, 72, 73.

Figure 5:
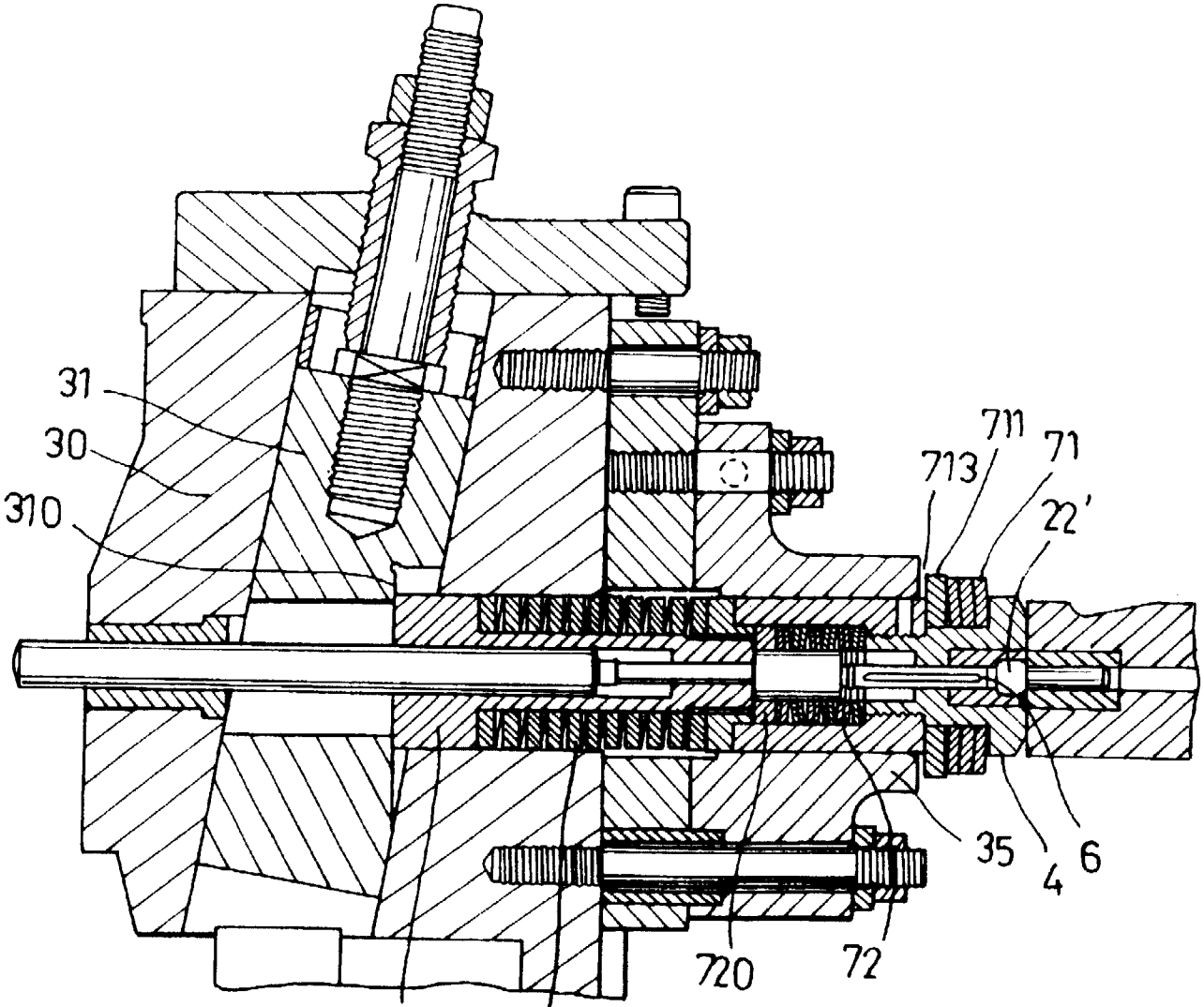

Referring to FIG. 5, because the third spring unit 73 has a spring force which is smaller than that of either of the first and second spring units 71, 72, the third spring unit 73 is compressed partially prior to compression of the spring units 71, 72, the first pusher 8 contacts the washer 720, and the die seat 35 moves toward the washer 711, thereby leaving a reduced space 713 between the die seat 35 and the washer 711. At this time, the blank is forged as a second semi-finished product 22' which is further enlarged within the male die 4.

Figure 6:
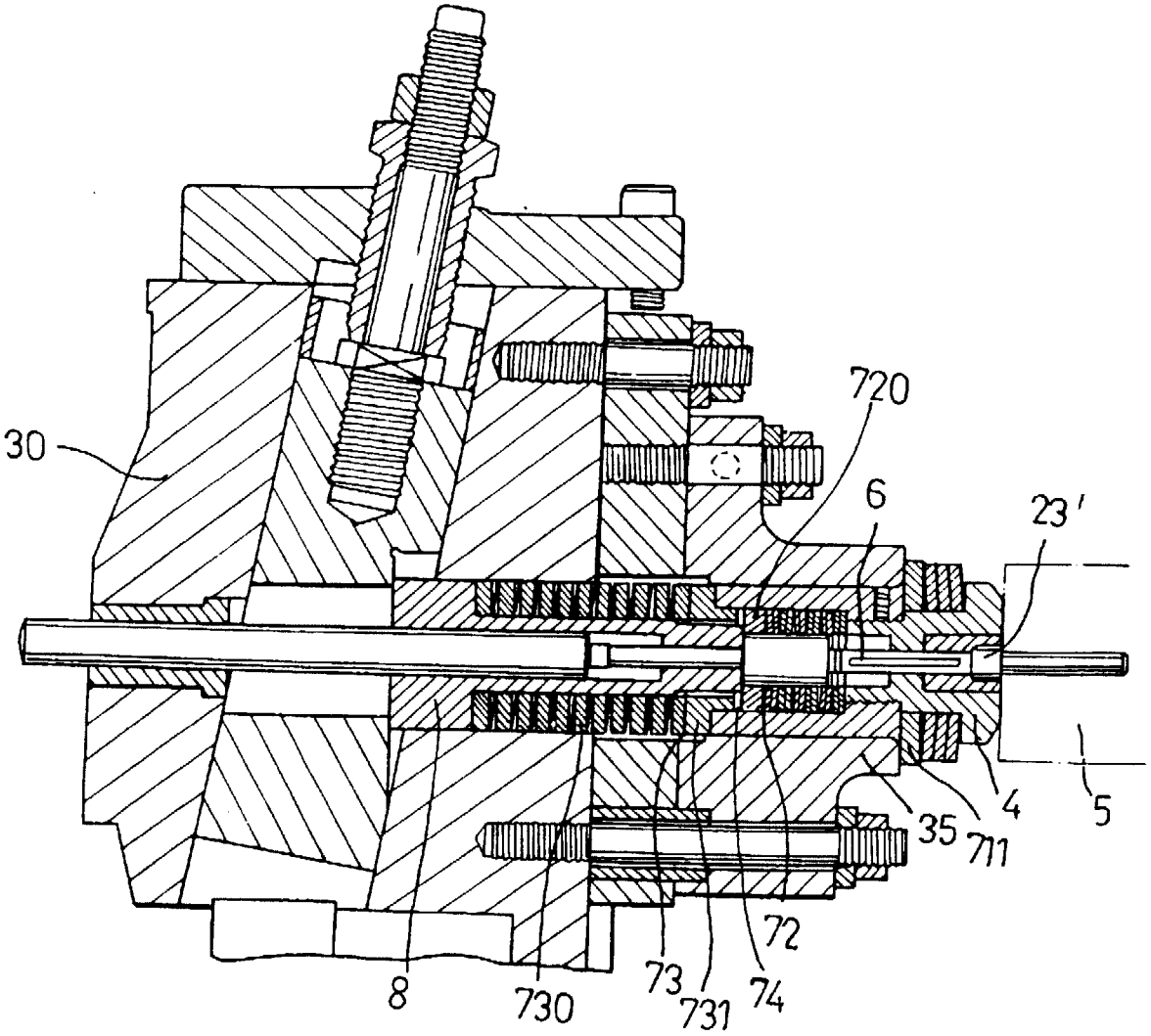

Referring to FIG. 6, the operating mechanism 3 is then moved to a position in which the die seat 35 contacts the washer 711. In this situation, the second spring unit 72 is compressed partially and the third spring unit 73 continues to be compressed, thereby defining a space 74 between the positioning ring 731 and the washer 720. At this time, the blank is forged as a third semi-finished product 23'.

Figure 7:
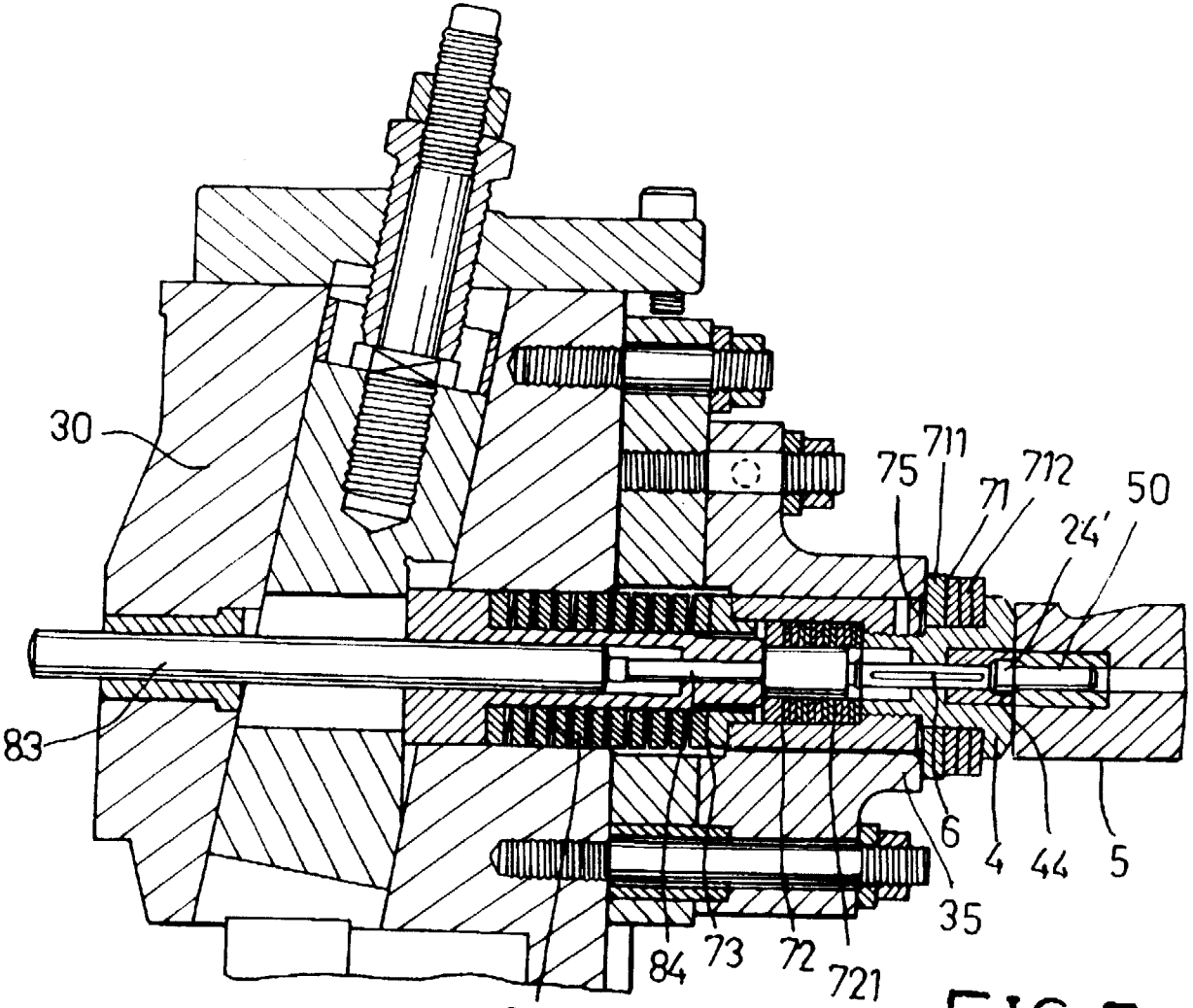

Referring to FIG. 7, the operating mechanism 3 is then moved to a stroke end position in which the blank is pressed entirely into the die cavities 44 and 50 and in which the spring units 71, 72, 73 are compressed completely so as to define a space 75 between the washer 711 and the die seat 35. Because the spring units 71, 72, 73 are compressed completely, movement of the male die 4 away from the female die 5 can be prevented. Accordingly, the male die 4 is pressed firmly against the female die 5 so as to forge the blank positively to form a fourth semi-finished product 24' which conforms with the die cavity 44 of the male die 4. It is understood that the operating mechanism 3 is moved to the left from then on by the crank (not shown) The fourth semi-finished product 24' is then taken out from the dies 4, 5 by operation of the main rod 83 and the auxiliary rod 84.

When the operating mechanism 3 moves from the position shown in FIG. 4 to that shown in FIG. 7, the total spring force of the spring units 71, 72, 73 to press the male die 4 against the female die 5 increases successively so as to conform with the successively increasing compressive force in the first die set which consists of the dies 4, 5. Total compressed length of the spring units 71, 72, 73 is sufficiently large to satisfy the one-stroke travel of the punch rod 6.

Figure 8:
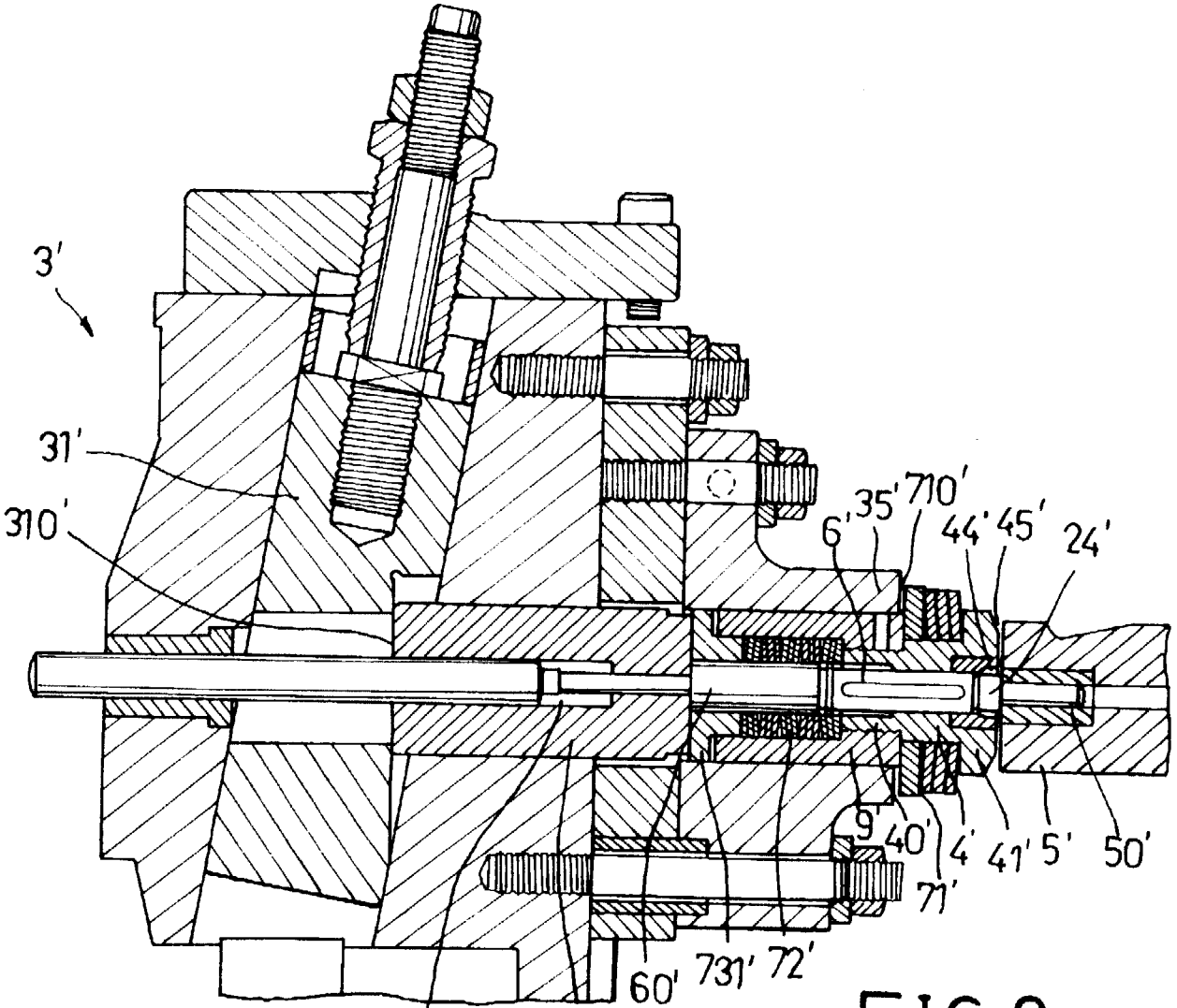
FIG. 8 is a sectional view of a second embodiment of the screwhead forming apparatus according to this invention.

FIG. 8 shows a second embodiment of this invention which includes an operating mechanism 3' with an axial hole 36', a first pusher 8', a second pusher 60', a punch rod 6', a second die set consisting of a male die 4' and a female die 5', and a retainer 9'. The operating mechanism 3' includes an adjustment block 31' having a pushing surface 310', and a die seat 35'. The male die 4' has a narrowed and section 40' and an enlarged end section 41', and is formed with a die cavity 44' having a hexagonal cross-section. The female die 5' has a die cavity 50'. A space 45' is left between the dies 4' and 5'.

Because the second die set is provided to forge a circular-cross-sectioned section of the fourth semi-finished product 24' to form a hexagonal screwhead, the spring force required to seal the die set is smaller than that of the previous embodiment. Furthermore the one-stroke travel of the punch rod 6' is shortened as compared to the previous embodiment. Accordingly, in this embodiment, the third spring unit 73 (see FIG. 3) is eliminated. The first pusher 8' is generally cylindrical to occupy the space which is occupied by the third spring unit 73 (see FIG. 3) and the first pusher 8 (see FIG. 3) of the first embodiment. In other words, the spring assembly of this embodiment consists of a first spring unit 7l' and a second spring unit 72'. A space 710' is let between the die seat 35' and the first spring unit 71'. A positioning ring 731' is sleeved on the second pusher 60' and is located between the first pusher 8' and the second spring unit 72'. A space 733' (FIG. 9) is left between positioning ring 731''' and the retainer 9'.

Figure 9:
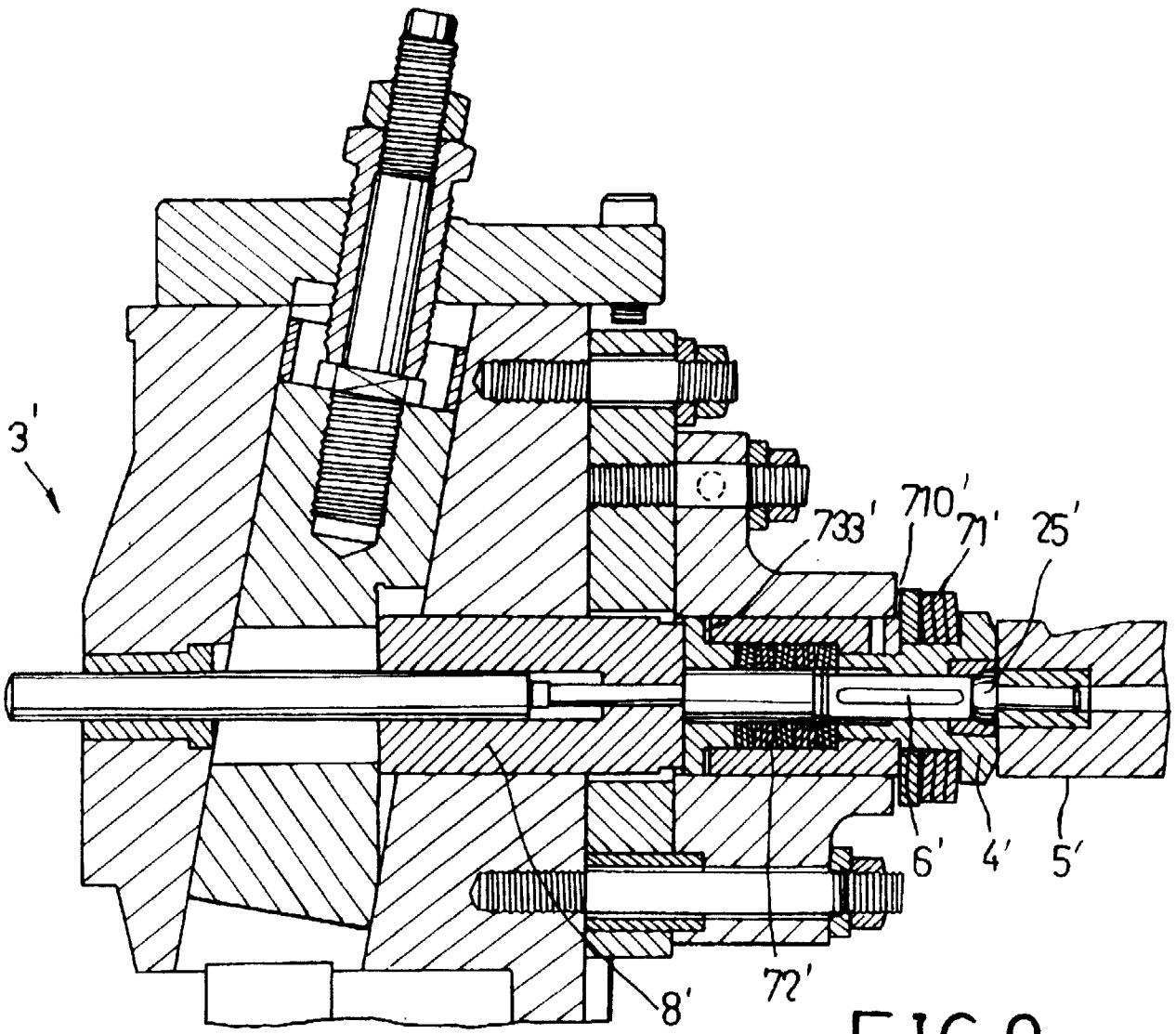
FIGS. 9 to 11 illustrating how a screwhead is formed in a second die set of the second embodiment.
Figure 10:
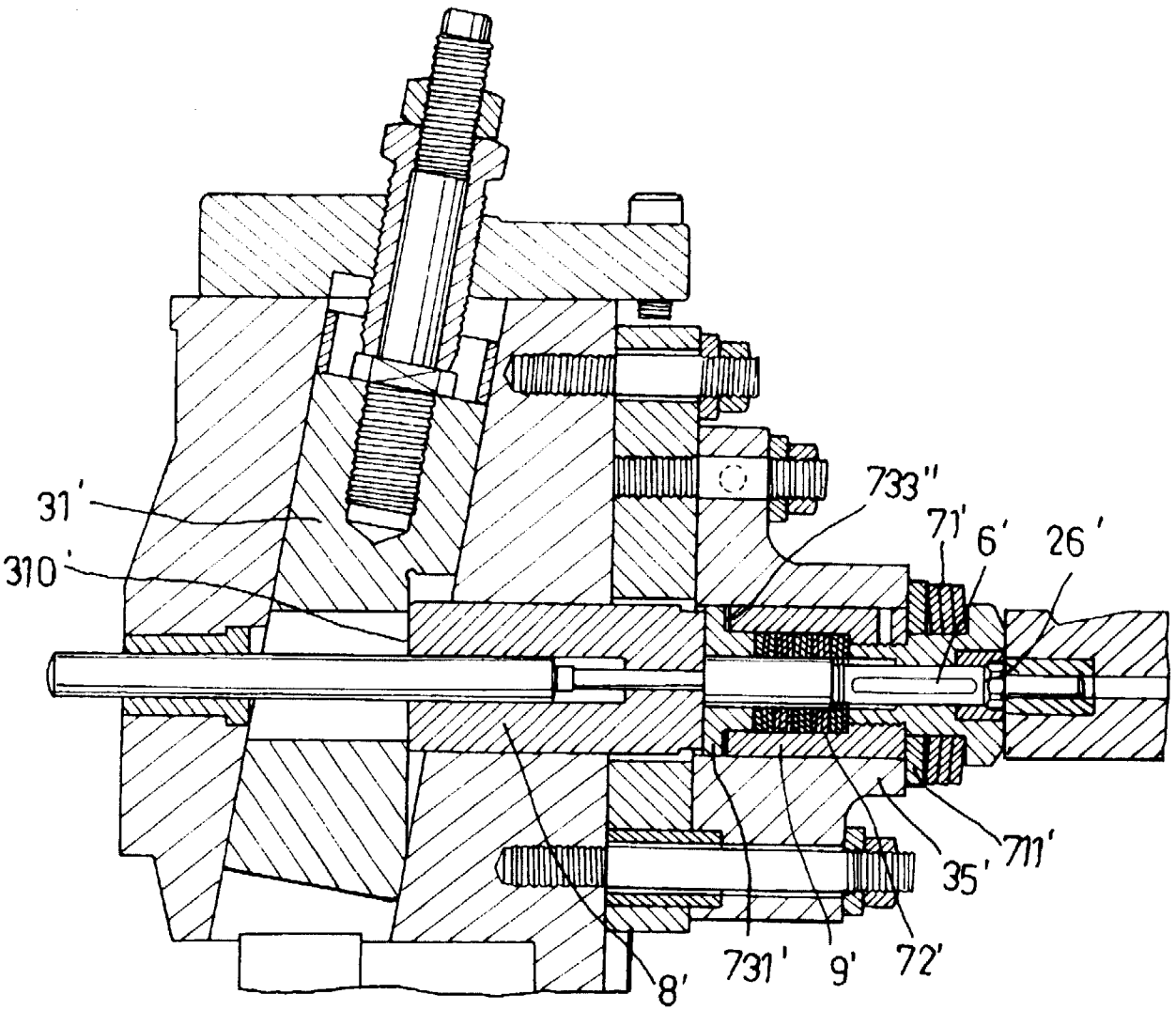
Figure 11:
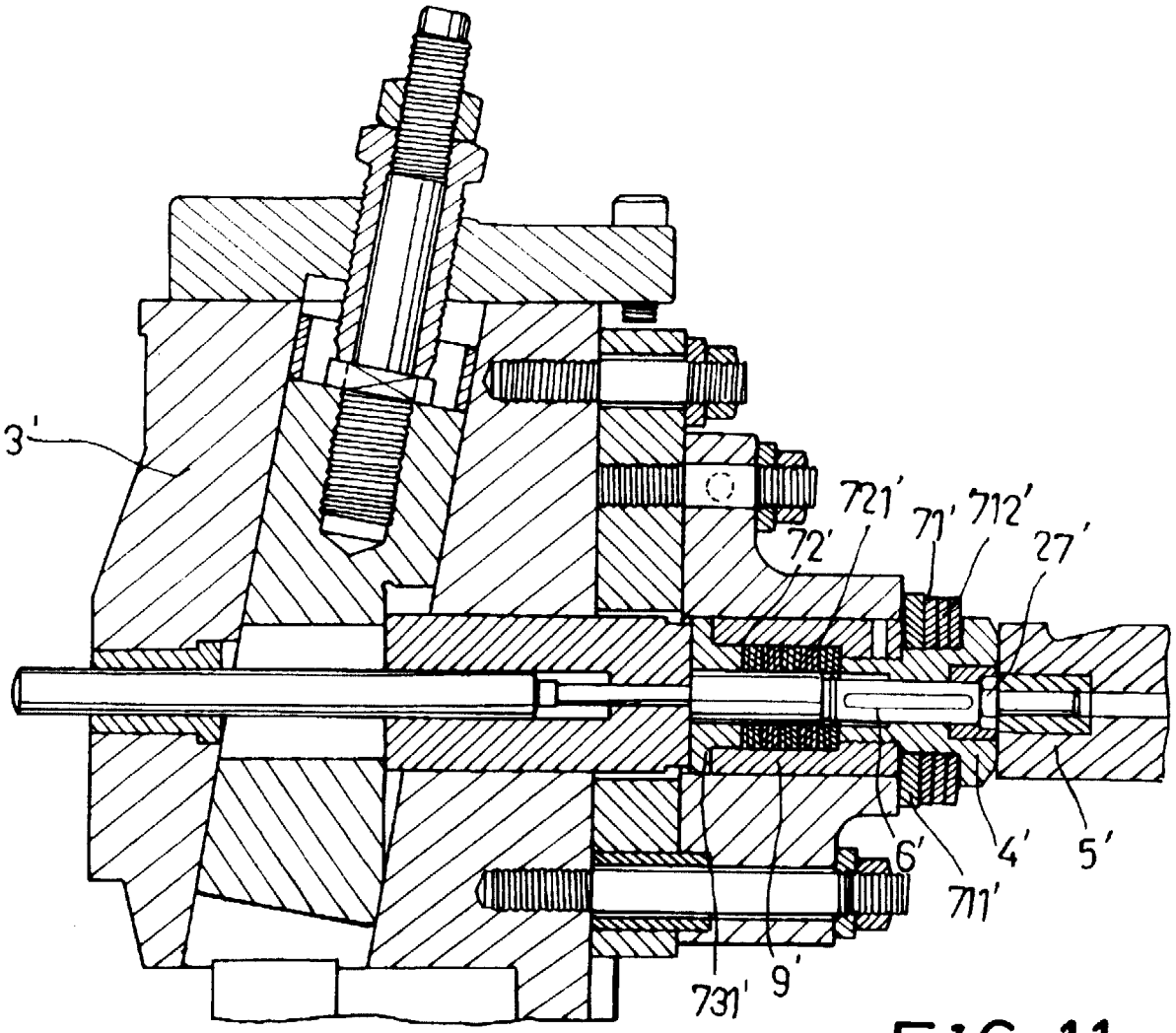

FIGS. 9 to 11 illustrate one stroke of the punch rod on the blank within a very short time, which takes place during a half revolution of the crank (not shown) that activates the operating mechanism 3'.

Referring to FIG. 9, when the operating mechanism 3' and the punch rod 6' are moved to positions in which the male die 4' contacts the female die 5', the blank is further pressed into the male die 4' and is forged to form a fifth semi-finished product 25'. Because the male die 4' contacts and cannot move relative to the female die 5', subsequent movement of the punch rod 6' in the male die 4' compresses the spring assembly which consists of the spring units 71', 72'.

Referring to FIG. 10, because the second spring unit 72' has a spring force which is smaller than that of the first spring unit 71', the second spring unit 72' is compressed partially prior to compression of the first spring unit 71', the die seat 35' contacts the washer 711', and the positioning ring 731' moves axially toward the retainer 9', thereby leaving a reduced space 733" between the positioning ring 731' and the retainer 9'. At this time, the blank is forged as a sixth semi-finished product 26'.

Referring to FIG. 11, the operating mechanism 3' is then moved to a stroke end position in which the blank is pressed entirely into the male dies 4',female die 5' and in which the spring units 71', 72' are compressed completely so as to move the positioning ring 731' axially to contact the retainer 9'. Because the spring units 71', 72' are compressed completely, removal of the male die 4' from the female die 5' can be prevented. Accordingly, the male die 4' is pressed firmly against the female die 5'0 so as to forge the blank positively to form a seventh semi-finished product 27' which conforms with the die cavity 44' of the male die 4'.

Figure 12:
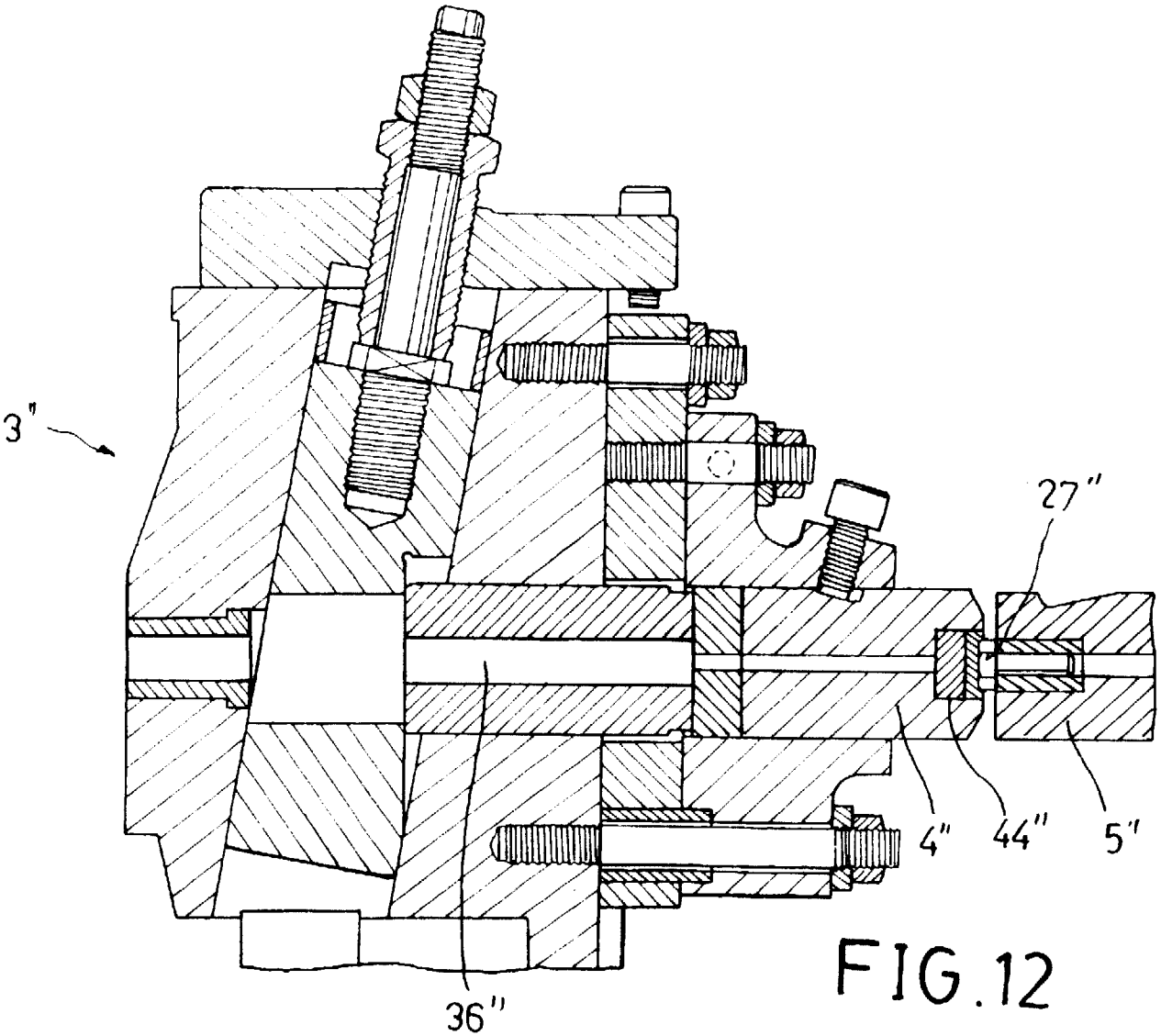
FIG. 12 is a sectional view of a trimming apparatus provided with a third die set for trimming a semi-finished product which is formed by the second embodiment

FIG. 12 shows a trimming apparatus provided with a trimming die set which includes a male die 4" and a female die 5" and which can remove irregular edges of the seventh semi-finished product 27' (see FIG. 11) by actuating an operating mechanism 3". Because only a relatively small force is applied to forge the seventh semi-finished product 27' in order to form a final product 27" in a die cavity 44" of the male die 4", no spring units are provided in an axial hole 36" in the operating mechanism 3".

With this invention thus explained, it is apparent that numerous modifications and variations can be made without departing from the scope and spirit of this invention. It is therefore intended that this invention be limited only as indicated in the appended claims

I claim.:

1. A screwhead forming apparatus, including:

a stationary female die;

an operating mechanism capable of being driven to reciprocate relative to the female die;

a male die driven by the operating mechanism to reciprocate relative to the female die and having a die cavity of a predetermined shape; and a punch rod driven by the operating mechanism to impel an elongated blank into the die cavity of the male die so as to forge the blank;

wherein the improvement comprises: a compression spring assembly disposed between the operating mechanism and the male die, the spring assembly comprising a plurality of spring units, each spring unit having a spring force different than the other spring units, the spring units being cooperatively arranged within the spring assembly to collectively urge the male die toward the female die during movement of the punch rod toward the female die such that, after the male die is brought into contact with the female die by the operating mechanism, the spring assembly biases the male die against the female die with a successively increasing force, and such that each of the spring units is fully compressed just before the blank is fully displaced into the cavity of the male die, thereby preventing movement of the male die away from the female die during screwhead formation.

2. A screwhead forming apparatus as claimed in claim 1, wherein the operating mechanism has an axial hole which is formed therethrough and which receives slidably the punch rod therein, the male die having a narrowed end section extending slidably into an end of the axial hole and an enlarged end section, the spring assembly including a first spring unit which is sleeved on the male die near the operating mechanism and which is located between the operating mechanism and the enlarged end section of the male die, a second spring unit disposed in the axial hole of the operating mechanism, and a third spring unit disposed in the axial hole of the operating mechanism in such a manner that said second spring unit is located between the first and third spring units, said second spring unit having a spring force which is smaller than that of said first spring unit and which is larger than that of said third spring unit, and a maximum compressible length which is larger than that of said first spring unit and which is smaller than that of said third spring unit.

3. A screwhead forming apparatus as claimed in claim 1, wherein the operating mechanism has an axial hole which is formed therethrough and which receives slidably the punch rod therein, the male die having a narrowed end section extending slidably into an end of the axial hole and an enlarged end section, the spring assembly including a first spring unit which is sleeved on the male die near the operating mechanism and which is located between the operating mechanism and the enlarged end section of the male die, and a second spring unit disposed in the axial hole of the operating mechanism, said second spring unit having a spring force smaller than that of said first spring and a maximum compressible length which is larger than that of said first spring unit.

* * * * *